United States Patent [19]

Houston

[11] Patent Number: 4,671,313

[45] Date of Patent: Jun. 9, 1987

[54] SLIDE VALVE

[76] Inventor: James L. Houston, 4329 South Lakewood, Tulsa, Okla. 74135

[21] Appl. No.: 772,127

[22] Filed: Sep. 3, 1985

[51] Int. Cl.[4] ..... F16K 3/316

[52] U.S. Cl. ..... 137/315; 251/326

[58] Field of Search ..... 251/326, 327, 328, 329, 251/367; 222/600; 137/315, 375

[56] References Cited

U.S. PATENT DOCUMENTS

| | | | |
|---|---|---|---|
| 3,701,359 | 10/1972 | Worley et al. | 137/375 |
| 4,378,817 | 4/1983 | Houston | 137/315 |
| 4,615,506 | 10/1986 | Houston | 251/326 |

*Primary Examiner*—Martin P. Schwadron
*Assistant Examiner*—Stephen M. Hepperle
*Attorney, Agent, or Firm*—Head, Johnson & Stevenson

[57] ABSTRACT

This is a new slide valve arrangement, it includes a housing having a longitudinal axis and a disc valve or gate movable by external hydraulic or mechanical actuator. The gate slides along a first surface of a guide member. There is a throat member through which the material to be regulated is directed. The throat and housing support a fixed plate. The guide member is held in position by a column support between the housing and the upper side of the guide. The guide member is held on the underside by a securing bar supported by gusset supported from the housing. The guide member is held against lateral movement by bolt extending through the guide member and screwed into a removable bolting bar which is positioned by a stop block which is secured to the gusset. Shim means are provided to adjust the vertical clearance between the throat and the gate and horizontal clearance between the gate and the guide member.

11 Claims, 6 Drawing Figures

SLIDE VALVE

RELATED APPLICATIONS

This invention is related to U.S. patent application Ser. No. 740,382 filed June 3, 1985, now U.S. Pat. No. 4,615,506, and entitled "SLIDE VALVE" by James L. Houston.

BACKGROUND OF THE INVENTION

This invention relates to a slide valve having a gate or disc which may be rectangular in shape and which is movable along a guide member to open, close or partly open or close the throat of the slide valve through which the fluid flows.

A typical slide valve is shown in my U.S. Pat. No. 4,378,817 issued Apr. 5, 1983 and entitled "SLIDE VALVE ASSEMBLY". The invention disclosed herein is an improvement of the disclosure in that patent.

SUMMARY OF THE INVENTION

This is a slide valve assembly which makes a slide valve which is stronger when hot when the prior art valves when hot. The assembly includes a housing having a longitudinal axis and a disc valve or gate which is movable linerally by an outside actuator. The gate moves along a first surface of a guide member. A throat through which the incoming fluid flows is also provided. Vertical securing means are provided to hold the guide member in a selected vertical position with respect to the longitudinal axis and second securing means are provided to hold the guide member in a selected lateral position, i.e., horizontal or lateral position means along a plane perpendicular to the longitudinal axis.

The vertical support means includes a plurality of support columns positioned between the top side of the guide member and a fixed plate secured to the housing. The vertical support member also includes a notched gusset secured to the housing and having a security bar through the notch whereby the guide member can be forced against the support column.

The side support member for the guide plate includes a fixed stop supported by the gusset, a removable bolting bar between the fixed stop and the wall of the housing and a bolt extending through the guide member and attached to the bolting bar.

The support column will be exposed to more heat than the valve body itself which is insulated on the inside to a certain degree and exposed on the outside to the normal air. Thus, the support columns will be subject to more thermal expansion forces than the body of the valve and will thus increase the strength of the tool against the exterior longitudinal loading forces.

DETAILED DESCRIPTION OF THE PREFERRED EMBODIMENT

Figure 1:
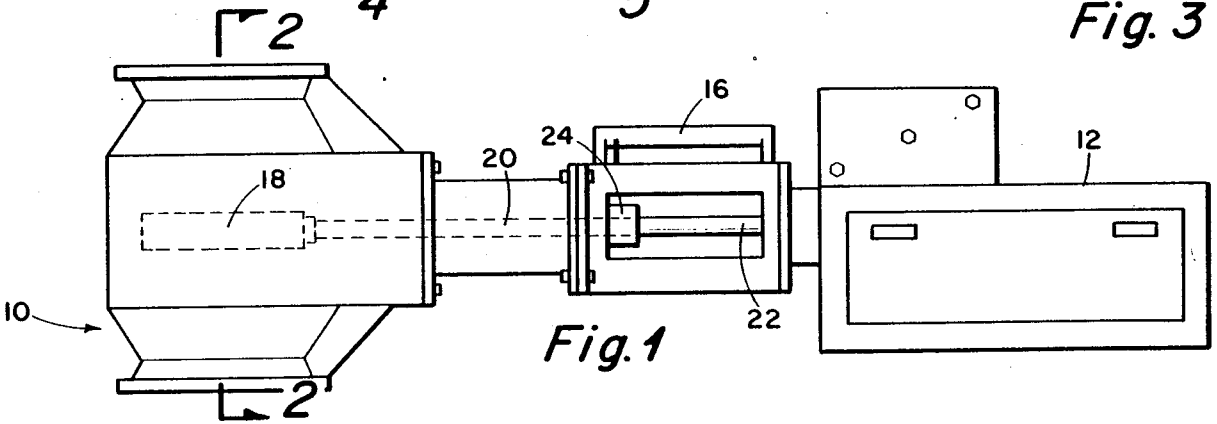
FIG. 1 is a side view of a slide valve assembly with external actuator and the gate indicated therein.

Attention is first directed to FIG. 1 which shows a slide valve case or housing 10, and a stuffing box with opening indicator 16. Shown in dashed line is a gate or disc 18 which is connected by a spindel or shaft 20 to stem 22 by any well known connecting means 24. Stem 22 is connected to actuator 12. The actuator 12 causes the valve 18 to move toward either the closed positioned indicated or to the right to an opened position or any position between the fully closed and fully opened position. The position of the gate 18 is shown by indicator 16. The general arrangement of the slide valve assembly of FIG. 1 may be conventional. The gate 18 is normally rectangularly shaped. The general concept of slide valves is well known so it is not believed that any further discussion of the general nature of the slide valve is essential.

Figure 2:
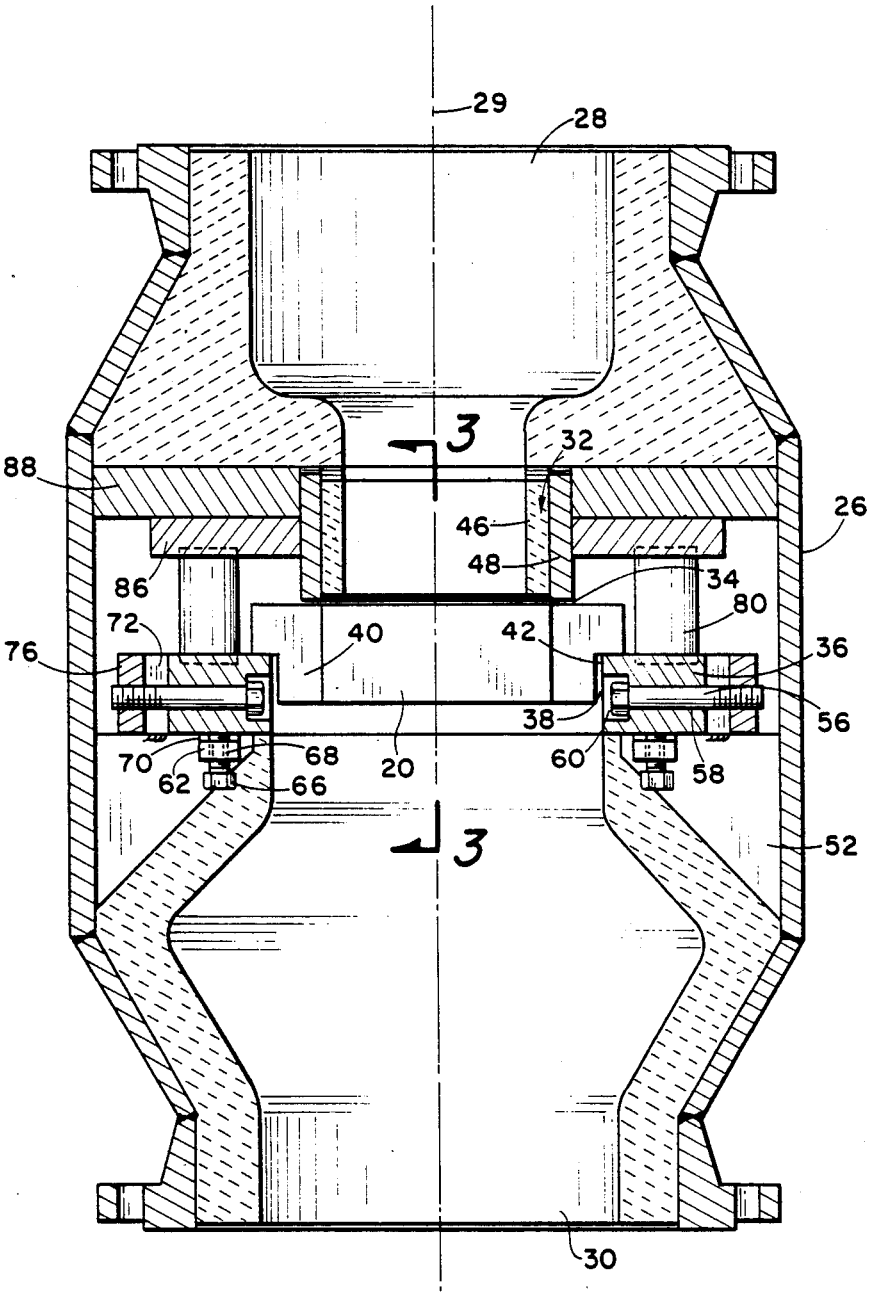
FIG. 2 is a view taken along the line 2—2 of FIG. 1.
Figure 5:
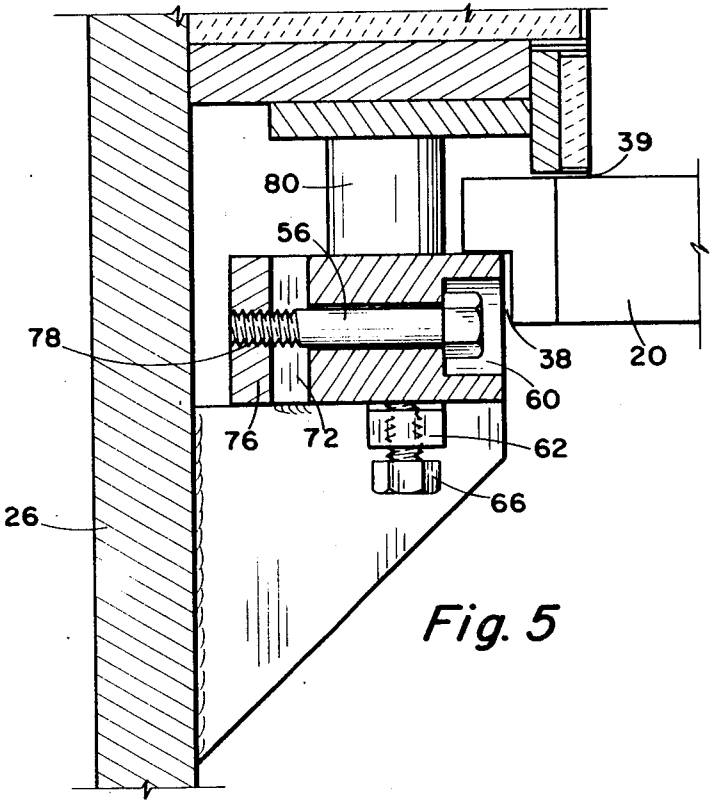
FIG. 5 is a view taken along the line 5—5 of FIG. 3.
Figure 4:
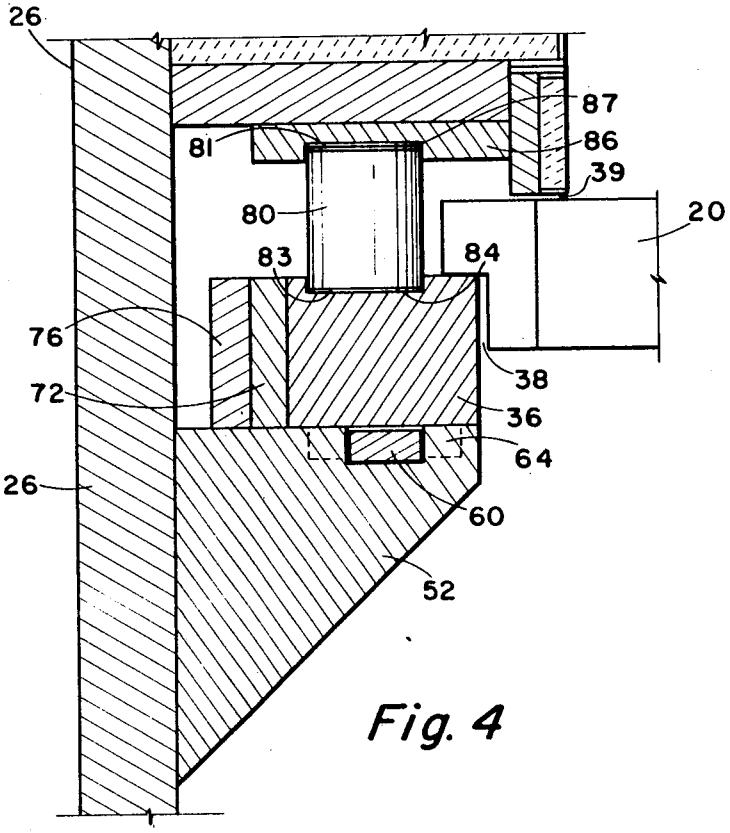
FIG. 4 is a view taken along the line 4—4 of FIG. 3.

Attention is next directed to FIG. 2 which shows a sliding valve housing 26 having an inlet 28 and an outlet 30 and a longitudinal axis 29. Provided therebetween is a throat member 32 and a gate valve 20. A top clearance is provided as clearance 34 between the bottom of throat 32 and the top of gate 20. The gate slides along a valve guide member 36. A side clearance is considered clearance 38 between the side of section 40 of gate 20 and the side 42 of guide member 36. Throat 32 may be any selected shape but is preferably a circular member 44 made of steel and aligned with a refractory material 46.

Figure 3:
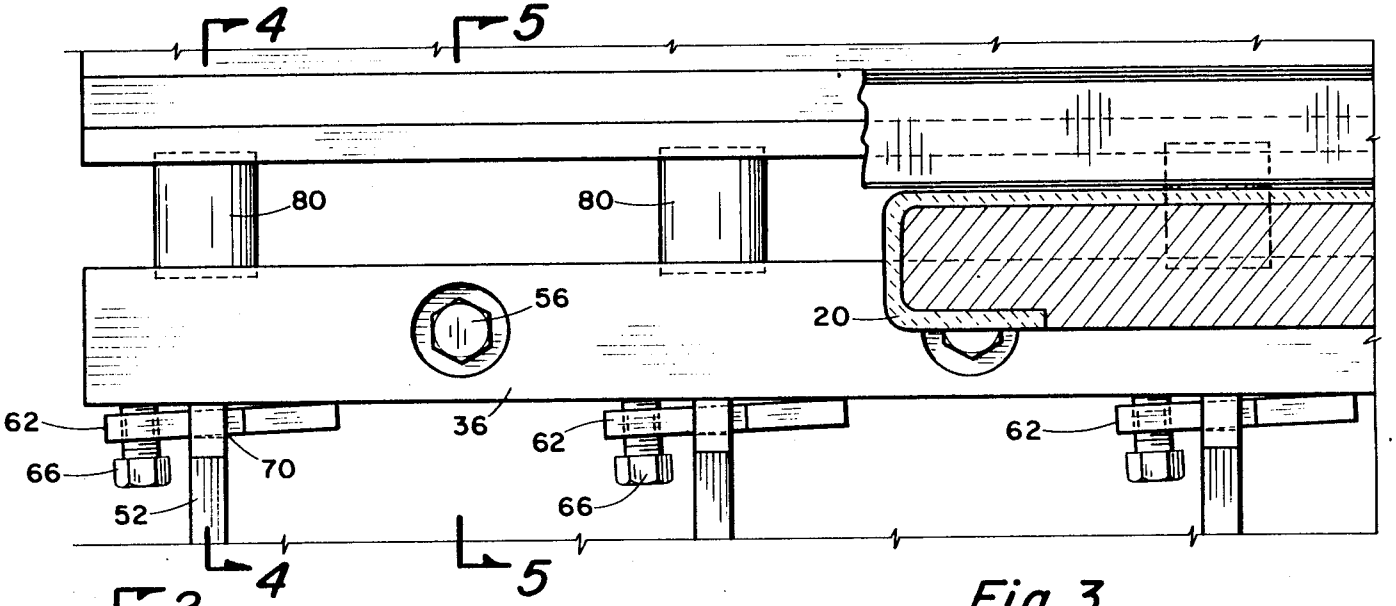
FIG. 3 is a view taken along the line 3—3 of FIG. 2.

Guide member 36 is suitably supported so it can be used with shims to adjust both the side clearance 38 and the top clearance 34. Such support means will now be discussed. A supporting gusset 52 is provided for the guide member 36. Preferably a securing bar 62 with securing bolt 66 is provided in notch 70 of gusset 52. This feature is shown more clearly in FIG. 6 which shows the securing bar 62 as being T-shaped with a T-cross 64 and a T-leg 60 which extends through the notch 70. The T-leg 60 is provided with a bolt 66 threaded through threaded hole 68. The notch 70 is slightly deeper than the thickness of the securing bar 62. This is to permit T-cross 64 to apply an upward force against the bottom of guide member 36 as nut or bolt 66 is tightened through hole 68 against the lower side of guide member 36. As clearly shown in FIG. 3, guide member 36 extends along a plurality of gussets 52 and in this case, it is illustrated as being 3 when it can be any desired number. Each such gusset 52 has the notch 70 and securing bar 62.

The upper side of guide member 36 is held in position by a column support 80 which is preferably cylindrical in shape. A fixed plate 86 having hole 87 is provided directly above hole 84 which is in the top side of guide plate or guide member 36. Fixed plate 86 is fixed to the housing 26 in any acceptable manner. Shims 81 and 83 may be provided in holes 87 and 84 respectively to give the proper adjustment for the desired vertical clearance 39.

We shall next discuss the part of this valve assembly which holds the guide member 36 in its lateral position. Lateral position means that the position with respect to the perpendicular to the longitudinal axis 29. This includes a fixed stop 72 which is fixed such as by welding to support gusset 52. On the outside of fixed stop 72 is a removable bolting bar 76. This bar merely sits on top of the plurality of gussets 52. It has a threaded hole 78 therethrough. Guide member 36 is provided with a clean bore 58 with countersink 60. The bore 58 is slightly larger than the bolt 56. Bolt 56 is provided with a threaded end for threadably connecting to threaded hole 78 in the removable bolting bar 76. Shims can be added between the fixed block 72 and the guide member 36 to adjust the side clearance 38.

I can build new slide valves in accordance with the concept of this invention or I can modify existing slide valves to receive my assembly. In order to modify existing slide valves, I have to modify or provide gussets 52 with a proper notch 70 and fixed stop 72. If the valves do not have this, I can simply weld in the appropriate gussets at the appropriate positions. I can also weld in or otherwise secure fixed plate 86 with hole 87 as needed. Then I can assemble the internal elements including the guide member 36, the removable bolting bar 76, support column 80 and securing bar 62.

Figure 6:
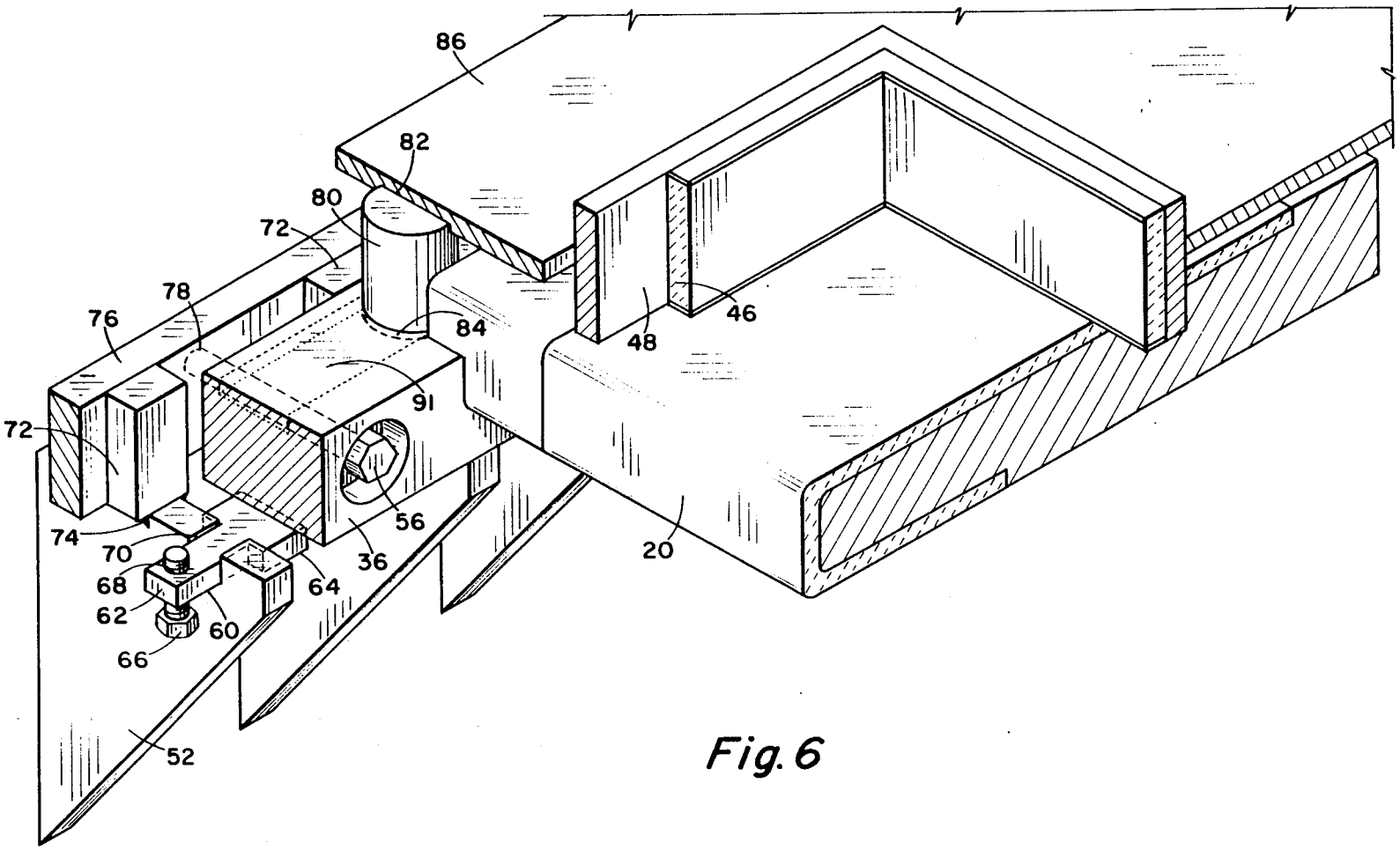
FIG. 6 is an isometric view of the slide member, the gate and means for supporting the guide member from the valve housing.

It is quite easy to assemble the guide member and means for obtaining the top clearance and side clearance into a valve. I position the support column 80 in holes 84 and 87 in guide member 36 and fixed plate 86 respectively. There is normally adequate slack or tolerance in the assembly to permit the support column 80 and the shims 81 and 83 to be inserted as desired. This slack can be removed by tightening securing bolts 66 once the support columns 80 and selected shims have been inserted. The securing bolt 66 is tightened sufficiently so that the securing bar T-cross 64 forces the guide member 36 upwardly to securely hold it in the proper position. Alternatively, instead of having holes 84 in guide member 36, there can be a longitudinal groove 91 as indicated in FIG. 6 by dotted lines and would be the same width as the diameter of hole 84. In some circumstances, the groove 91 might facilitate the insertion of the support column 80 and the supporting shims.

In order to get the proper side clearance 38, I add shims as may be necessary between guide member 36 and fixed stop block 72. I then secure the guide member 36 to removable bolting bar 76 by tighening bolt 56 as required. The guide member is now in its proper position with proper side clearance 38 and proper vertical clearance 34. If the shims which are calculated to be inserted do not give the proper clearances, then one can, of course, merely change the shims as necessary.

This assembly described herein makes for a slide valve which is quite strong when hot and much stronger than the prior art valves when they are hot. When the hot material flows through my slide valve, column 80 is subjected to more heat and thus higher temperature than is the housing 26. This is because the housing 26 is exposed to the cooler ambiant air and also it has refractory material on the inside thereof. This column 80 is subject to considerably more thermal expansion than is the housing 26. This increases the strength of the tool against exterior longitudinal loading forces. When metal gets extremely hot as in this valve, if compensations are not made, it will decrease in strength. However, here with my valve, I compensate for the loss due to heat by the arrangements just described.

While this invention has been described with a certain degree of particularity, it is manifest than many changes may be made in the details of construction in the arrangement of components without departing from the spirit and scope of the disclosure. It is understood that the invention is not limited to the embodiments set forth herein for purposes of exemplification, but is limited only by the scope of the attached claim or claims, including the full range of equivalency to which each element thereof is entitled.

What is claimed:

1. A slide valve comprising:

a housing having a longitudinal axis;

a gate having a first side;

a guide member having a first surface along which said gate may slide and a second surface;

a rigid column support between said housing and the first surface of said guide member;

a securing means between said housing and the second surface of said guide member for holding said guide member in contact with said column support, a fixed plate attached to said housing, a hole in said fixed plate for said column support, said hole having a cross section substantially equal to an abuting cross section of said column support.

2. A slide valve as defined in claim 1 in which said securing means includes a plurality of gussets attached to said housing each with a notch in a first side, a securing bar extending through said notch with a threaded hole therein and a jack bolt threaded through said hole.

3. A slide valve as defined in claim 1 wherein said securing means includes a plurality of gussets having a first side and a second side with said first side attached to said housing and a fixed stop attached to the second side of said gusset;

a bolting bar having a threaded hole and positioned between said stop and said housing;

a bolt extending through said guide member into said threaded hole in said bolting bar.

4. A slide valve as defined in claim 3 including shim means insertable between said support column and said guide member.

5. A slide valve as defined in claim 4 including shim means insertable between said fixed stop and said guide member.

6. A slide valve as defined in claim 3 including a hole in the first surface of said guide member.

7. A slide valve as defined in claim 3 including a groove in said guide member for receiving an end of said support column.

8. An assembly for use with a slide valve having a gate and an internal member fixed to its housing which comprises:

a guide member having a first surface upon which said gate may slide;

a plurality of gussets having a first side and attachable to the housing of said slide valve and a fixed stop mounted on each said gusset;

a support column positionable between the first surface of said guide member and said internal member fixed to said housing;

a removable bolting bar insertable between said fixed stop and said housing, said bolting bar having a plurality of threaded holes therethrough;

a hole through said guide member for each said hole in said removable bolting bar;

a bolt extending through each said hole in said guide member and threadedly insertable into said threaded hole of said removable bolting bar;

jacking means for applying force between said guide member and said gusset.

9. An assembly as defined in claim 8 in which said jacking means includes a notch in the first side of said gusset, a securing bar of less thickness than the depth of said notch extending through said notch, one side of said securing bar having a cross-member and the other end having a threaded hole and a jacking bolt mounted in said threaded hole of said securing bar.

10. A slide valve comprising:

a housing having a longitudinal axis;

a gate having a first side;

a guide member having a plurality of holes therethrough and a first surface along which said gate may slide and a second surface;

a rigid column support between said housing and the first surface of said guide member;

a plurality of gussets having a first side attached to said housing;

a fixed stop attached to the first side of each said gusset;

a bolting bar having threaded holes therethrough and positioned between said stop and said housing;

a bolt for each threaded hole extending through a hole in said guide member into said threaded hole in said bolting bar.

11. A slide valve comprising:

a housing having a longitudinal axis;

a gate having a first side;

a guide member having a first surface along which said gate may slide and a second surface;

a rigid column support between said housing and the first surface of said guide member;

a plurality of gussets each having a first side attached to said housing, and a second side with a notch therein;

a securing bar extending through said notch with a threaded hole therein;

a jack bolt threaded through said hole.

* * * * *